United States Patent [19]

Yamaryo

[11] Patent Number: 4,922,792

[45] Date of Patent: May 8, 1990

[54] KEY MECHANISM FOR A WOOD WIND

[75] Inventor: Shigeru Yamaryo, Hamamatsu, Japan

[73] Assignee: Yamaha Corporation, Japan

[21] Appl. No.: 139,477

[22] Filed: Dec. 30, 1987

[30] Foreign Application Priority Data

Jan. 6, 1987 [JP] Japan ..... 62-001398

[51] Int. Cl.[5] ..... G10D 7/06

[52] U.S. Cl. ..... 84/382

[58] Field of Search ..... 84/380 R, 382

[56] References Cited

U.S. PATENT DOCUMENTS

| | | | |
|---|---|---|---|
| 1,529,567 | 3/1925 | Albert | 84/382 |
| 1,585,296 | 5/1926 | Loomis | 84/382 |
| 1,926,489 | 9/1933 | Leblanc | 84/382 |
| 2,508,550 | 5/1950 | Stubbins | 84/382 |
| 2,627,776 | 2/1953 | Leblanc | 84/382 |
| 2,775,915 | 1/1957 | De Ford | 84/380 |
| 2,832,250 | 4/1958 | Leblanc | 84/382 |

*Primary Examiner*—Lawrence R. Franklin

*Attorney, Agent, or Firm*—Lerner, David, Littenberg, Krumholz & Mentlik

[57] ABSTRACT

In construction of a key mechanism for a wood wind having an A key for an A sound hole, a register key for a Bb sound hole and for a lower vent tube, and a G/D key for the lower vent tube, a lock unit is provided to inhibit release of the lower vent tube when the A and register keys are concurrently operated for generation of a crisp Bb sound with reduced growls.

4 Claims, 1 Drawing Sheet

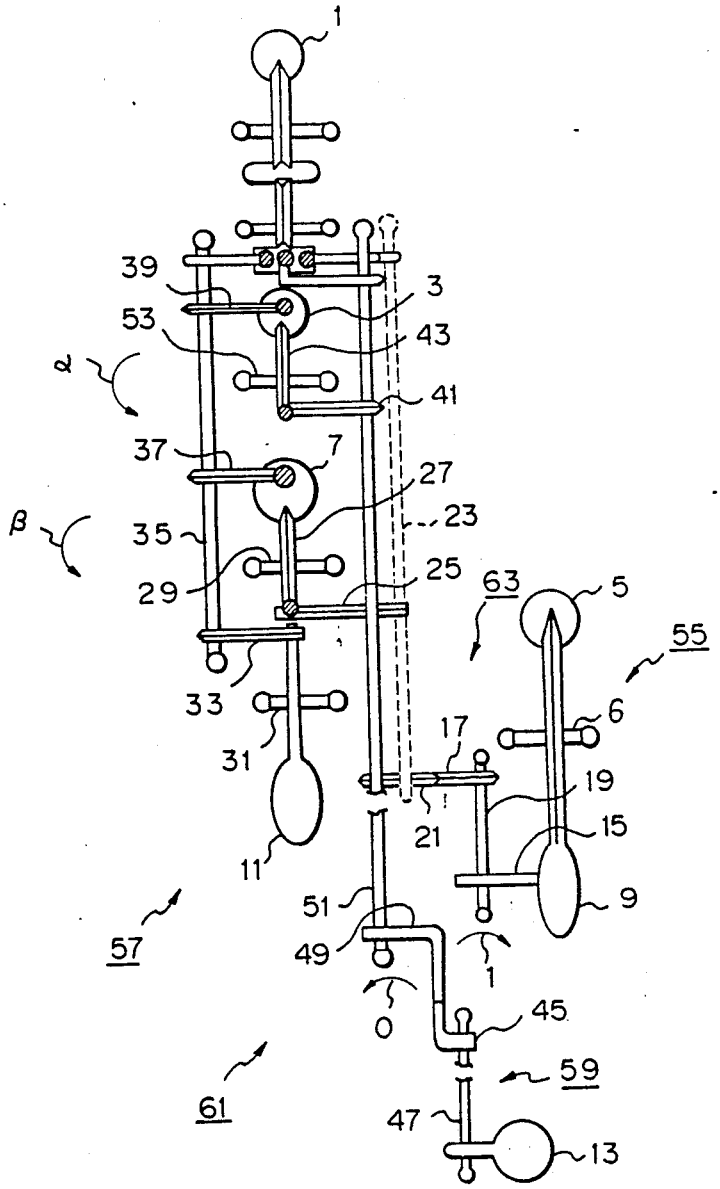
1
39
3
53
43
α
41
37
7
27
β
35
23
29
25
63
5
55
33
6
17
31
19
21
15
11
9
51
57
49
1
0
45
59
61
47
13

KEY MECHANISM FOR A WOOD WIND

BACKGROUND OF THE INVENTION

The present invention relates to an improved key mechanism for a wood wind, and more particularly relates to an improvement in construction of a key mechanism of a wood wind such as a bass clarinet for generation of a crisp B-flat sound.

A wood wind is in general provided with a key mechanism which extends over its upper and lower joints. Such a key mechanism includes a register key unit, a G/D key unit and an A key unit. The register key unit is provided with a register key mechanically coupled to a cap for controlling the state of a lower vent tube. The G/D key unit is provided with a G/D key. The A key unit is provided with an A key mechanically coupled to a cap for controlling the state of an A sound hole.

For generation of a B-flat sound, the left index finger of the player operates the A key of the A key unit and the associated cap releases the A sound hole. Concurrently, the player's left thumb operates the register key and the associated cap releases the lower vent tube. Thus, once the wood wind is blown via its mouthpiece, two air columns vibrate in the wood wind for generation of the B-flat sound. The period of the basic vibration of the first air column is fixed by the distance between the mouthpiece and the lower vent tube whereas the period of the basic vibration of the second air column is fixed by the distance between the mouthpiece and the A sound hole. In general on a wood wind, the lower vent tube is quite distant from the A sound hole along the length of the wood wind. As a consequence, the first and second air columns are quite different in period of basic vibration from each other. Such a significant difference in period of basic vibration results in generation of a B-flat sound which includes growls and lacks in crispness.

In order to obviate such a problem, one alternative is to provide a new sound hole adapted for independent generation of a B-flat sound. This expedient, however, requires change in the traditional finger motion by the player for operation on an associated new key and, as a consequence, quite unemployable in practice.

SUMMARY OF THE INVENTION

It is the object of the present invention to enable generation of a crisp B-flat sound without any change in the traditional finger motion.

In accordance with the basic aspect of the present invention, a lock unit is provided in combination with the register key and G/D key units in order to inhibit release of a lower vent tube when the A key and register key units are concurrently operated.

BRIEF DESCRIPTION OF THE DRAWINGS

The attached drawing is a front view of one embodiment of the key mechanism in accordance with the present invention.

DESCRIPTION OF THE PREFERRED EMBODIMENTS

In the drawing, the key mechanism includes an A key unit 55, a register key unit 57, a G/D key unit 59 and the first and second lock units 61 and 63.

The A key unit 55 includes an A key 9 swingable about the first fixed pin 6 and coupled to the first cap 5 for controlling the state of an A sound hole.

The register key unit 57 includes a register key 11 swingable about the second fixed pin 31 which extends in a direction parallel to the first fixed pin 6 of the A key unit 55. The register key 11 is coupled to the first rotary pin 35 via the first radial arm 33. The second and third radial arms 37 and 39 are secured to the first rotary pin 35 at spaced positions in parallel to each other. The distal end of the second radial arm 37 is normally kept in contact with the second cap 7 for controlling the state of a B-flat sound hole whereas the distal end of the third radial arm 39 is normally kept in contact with the third cap 3 for controlling the state of a lower vent tube.

The G/D key unit 59 includes a G/D key 13 secured to the second rotary pin 47 which extends in a direction normal to the first fixed pin 6 of the A key unit 55. The fourth radial arm 45 is also secured to the second rotary pin 47. This fourth radial pin 45 is bent at its midway in the direction of the second rotary pin 47.

The first lock unit 61 includes the third rotary pin 51 which extends in a direction normal to the first fixed pin 6 of the A key unit 55. At one end near the G/D key unit 59 is the fifth radial arm 49 secured to the third rotary pin 51. This fifth radial arm 49 is bent at its midway in the direction of the third rotary pin 51 and its free end is coupled to the free end of the fourth radial arm 45 of the G/D key unit 59. At the other end remote from the G/D key unit 59 is the sixth radial arm 41 secured to the third rotary pin 51. The free end of this sixth radial arm 41 is normally kept in contact with the underside of an arm 43 swingable about the third fixed pin 53 which extends in a direction parallel to the first fixed pin 6 of the A key unit 55. At the end remote from the sixth radial arm 41, this arm 43 is secured to the third cap 3 for the lower vent tube. Though not shown in the drawing, the arm 43 is spring loaded to swing in the direction of an arrow $\alpha$.

The second lock unit 63 includes the fourth rotary pin 23 which extends substantially in the direction of the third rotary pin 51 of the first lock unit 61. This fourth rotary pin 23 is located under the third rotary pin 51 and, as a consequence, shown with dot lines in the illustration. At one end near the A key unit 55 is the seventh radial arm 21 secured to the fourth rotary pin 23. The second lock unit 63 further includes the fifth rotary pin 19 which extends in a direction substantially normal to the first fixed pin 6 of the A key unit 55. This fifth rotary pin 19 is provided at its one end with the eighth radial pin 17 the free end of which is normally kept in contact with the underside of the seventh radial arm 21 on the fourth rotary pin 23. The fifth rotary pin 19 is further provided at its the other end with the ninth radial arm 15 the free end of which is normally kept in contact with the underside of the A key 9 of the A key unit 55. The fourth rotary pin 23 is further provided at its midway with a tenth radial arm 25 the free end of which is normally kept in contact with the underside of an arm 27 swingable about the fourth fixed pin 29 which extends in a direction parallel to the first fixed pin 6 of the A key unit 55. At the end remote from the tenth radial arm 25, this arm 27 is secured to the second cap 7 for the B-flat sound hole. Through not shown in the drawing, the arm 27 is spring loaded to swing in the direction of an arrow $\beta$.

With the above-described construction, the key mechanism operates as follows.

For generation of a B-flat sound, the A key 9 and the register key 11 are operated concurrently. As the A key 9 is operated, the first cap 5 releases the A sound hole and the fifth rotary pin 19 axially rotates in the clockwise direction (when seen from the side of the G/D key unit 59) with the ninth and eighth radial arms 15 and 17. Due to contact of the eighth radial arm 17 with the seventh radial arm 21, the fourth rotary pin 23 is driven for corresponding rotation in the counterclockwise rotation with the tenth radial arm 25 which gets out of contact with the spring loaded arm 27. As a consequence, the spring loaded arm 27 is now swingable about the fourth fixed pin 29. As the register key 11 is operated, the first rotary pin 35 is driven, via the first radial arm 33, for rotation in the counterclockwise direction with the second and third radial arms 37 and 39. As a consequence, the second radial arm 37 gets out of contact with the second cap 7 and the third radial arm 39 gets out of contact with the third cap 3. Due to the spring force, the arm 27 swings about the fourth fixed pin 29 so that the second cap 7 should release the B-flat sound hole. However, the spring loaded arm 43 is not allowed to swing in the same way due to contact with the sixth radial arm 41 of the first lock unit 61. Thus the concurrent operation on the A key 9 and the register key 11 releases the A sound hole and the B-flat sound hole. As is clear from the drawing, the B-flat sound hole is located by far closer to the A sound hole than the lower vent hole which is not released. As a consequence, in generation of the intended B-flat sound, the period of the basic vibration of the first air column is fixed by the distance between the mouthpiece and the B-flat sound hole whereas the period of the basic vibration of the second air column is fixed by the distance between the mouthpiece and the A sound hole. Since the B-flat and A sound holes are located close to each other, the first and second air columns are relatively close, though not the same, in period of basic vibration. Such a small difference in period of basic vibration results in generation of the B-flat sound with reduced growls and enriched crispness.

For change in tone range over 12 degrees of musical notes to be generated by operation on other key units, the G/D key 13 and the register key 11 are operated concurrently. As the G/D key 13 is operated, the second rotary pin 47 axially rotates in the clockwise direction with the fourth radial arm 45 and, via coupling between the fourth and fifth radial arms 45 and 49, the third rotary pin 51 is driven for axial rotation in the counterclockwise rotation with the sixth radial arm 41 which thereupon gets out of contact with the spring loaded arm 43. Due to the spring force, the arm 43 swings in the $\alpha$ direction about the third fixed pin 53. As the register key 11 is operated, the first rotary pin 35 is driven, via the first radial arm 33, for rotation in the counterclockwise direction with the second and third radial arms 37 and 39. Thus, the free ends of these radial arms 37 and 39 get out of contact with the second and third caps 7 and 3, respectively. Thanks to the above-described swingable state of the spring loaded arm 43, the third cap 3 releases the lower vent tube. However, as long as the A key 9 remains unoperated, the tenth radial arm 25 of the second lock unit 63 is kept in contact with the underside of the spring loaded arm 27. As a consequence, the second cap 7 is not allowed to release the B-flat sound hole. Thus, the sole release of the lower vent tube causes 12 degrees change in tone range of musical tones to be gnerated by operation on other key units.

I claim:

1. An improved key mechanism for a wood wind comprising an A key unit including an A key used for releasing an A sound hole via a first cap, a register key unit including a register key used for releasing a B-flat sound hole via a second cap as well as a lower vent tube via third cap, a G/D key unit including a G/D key used for releasing said lower vent tube via said third cap, and a first lock unit for inhibiting release of said lower vent tube when said A key and said register key are concurrently operated.

2. An improved key mechanism as claimed in claim 1 in which said third cap has a swingable arm coupled thereto and is spring loaded so as to urge said third cap to release said lower vent tube, and said register key unit includes a radial arm normally pressing said third cap against said lower vent tube, and said first lock unit includes a radial arm arranged in contact with said swingable arm of said third cap so as to inhibit the swing of said swingable arm due to a spring, said first lock unit radial arm being coupled to said G/D key unit so as to allow said swing of said swingable arm due to said spring when said G/D key is operated.

3. An improved key mechanism as claimed in claim 1 further comprising a second lock unit for inhibiting release of said B-flat sound hole when said G/D key and said register key are concurrently operated.

4. An improved key mechanism as claimed in claim 3 further comprising said second cap has a swingable arm coupled thereto and is spring loaded so as to urge said second cap to release said B-flat hole, and said register key unit includes a radial arm normally pressing said second cap against said B-flat hole, and said second lock unit includes a radial arm arranged in contact with said swingable arm of said second cap so as to inhibit the swing of said swingable arm due to a spring, said second lock unit radial arm being coupled to said A key unit so as to allow said swing of said swingable arm due to said spring when said A key is operated.

* * * * *